US005879070A

United States Patent [19]

Severloh

[11] Patent Number: 5,879,070

[45] Date of Patent: Mar. 9, 1999

[54] LOUVERED LIGHTING SYSTEM

[75] Inventor: Paul Severloh, San Dimas, Calif.

[73] Assignee: Anthony's Manufacturing Company, Inc., San Fernando, Calif.

[21] Appl. No.: 541,250

[22] Filed: Oct. 12, 1995

[51] Int. Cl.[6] ..... A47F 11/10

[52] U.S. Cl. ..... 362/125; 362/133; 362/351; 362/354; 362/224; 312/223.5

[58] Field of Search ..... 362/125, 92, 133, 362/224, 223, 260, 290, 291, 292, 351, 354; 321/223.5

[56] References Cited

U.S. PATENT DOCUMENTS

| | | | |
|---|---|---|---|
| 1,003,724 | 9/1911 | Felver . | |
| 2,123,361 | 7/1938 | Hollis | 362/125 |
| 2,336,416 | 12/1943 | Parker . | |
| 2,551,710 | 5/1951 | Slaughter . | |
| 2,761,058 | 8/1956 | Lipscomb . | |
| 2,874,271 | 2/1959 | Lipscomb . | |
| 3,169,710 | 2/1965 | Lipscomb . | |
| 3,389,246 | 6/1968 | Shemitz . | |
| 3,700,877 | 10/1972 | Wilson . | |
| 4,013,880 | 3/1977 | Kennedy, Jr. et al. . | |
| 4,054,793 | 10/1977 | Shemitz | 362/127 |
| 4,368,504 | 1/1983 | Sato et al. | 362/33 |
| 4,384,318 | 5/1983 | Reibling | 362/216 |
| 4,432,044 | 2/1984 | Lautzenheiser | 362/223 |
| 4,739,454 | 4/1988 | Ferergreen | 362/133 |
| 4,800,473 | 1/1989 | Tremblay | 362/217 |
| 4,955,044 | 9/1990 | Amstutz et al. | 362/125 |
| 5,301,092 | 4/1994 | Santosuosso et al. | 362/125 |
| 5,437,504 | 8/1995 | Halvatzis | 362/125 |
| 5,645,330 | 7/1997 | Artwohl et al. | 362/125 |

FOREIGN PATENT DOCUMENTS

| | | |
|---|---|---|
| 0198088 | 9/1985 | European Pat. Off. . |
| 627376 | 6/1927 | France . |
| 2654602 | 11/1989 | France . |
| 3541573 | 11/1985 | Germany . |
| 8533752 | 11/1985 | Germany . |
| 2248676 | 4/1992 | United Kingdom . |

*Primary Examiner*—Thomas M. Sember
*Attorney, Agent, or Firm*—Henricks, Slavin & Holmes LLP

[57] ABSTRACT

A light fixture is disclosed including a receptacle for receiving a light source and a support for the receptacle. At least one baffle supported adjacent the light source inhibits passage of light from the light source past the at least one baffle. An enclosure surrounds the light sources and engages the support in such a way that airflow from outside the enclosure to the light source is substantially prevented. A display case is also disclosed having a product support within a frame for supporting the product to be displayed within the display case and a light fixture for receiving and supporting a light source. At least one baffle element is positioned adjacent to light fixture and between the fixture and the product support for reducing the amount of light from the light source that passes from the light source outside of the display case.

36 Claims, 10 Drawing Sheets

LOUVERED LIGHTING SYSTEM

CROSS-REFERENCE TO RELATED APPLICATIONS

This application is a continuation-in-part of application Ser. No. 08/486,523, filed Jun. 7, 1995.

BACKGROUND OF THE INVENTION

1. Field of the Invention

The present invention relates generally to lighted display cases and more particularly to display cases having light sources that direct light inside the case and toward products, such as might be supported by display case shelves.

2. Related Art

In the past, a variety of shelves have been used inside display cases for the purpose of displaying different items in supermarkets, or other retail establishments. Items for sale are typically placed on the shelves in rows or columns. For example, dairy products in a supermarket may be placed on shelves inside a refrigerated display case with the earlier dated dairy products, which need to be sold first, located near the front and middle of the shelves where the products maybe easily selected by customers. However, problems are encountered in illuminating products arranged in such manner. Products located near the middle of the display shelves are difficult to illuminate when vertical florescent lamps or other lights located near the ends of the shelves are used to light or illuminate the interior of a display case. In such a case, the products located near the lights receive more light or illumination than products located near the front and middle of the shelves. As a result, products near the middle of the shelves are insufficiently illuminated. Additionally, the contrast or uniformity with which the products are illuminated varies significantly from the end of the shelf adjacent the lamp to the middle of the shelf.

When products are positioned on shelving near the light sources in a display case, undesirable glare or excessive bright regions are formed about the products. This localized area of illumination adversely affects the ability to more uniformly illuminate all products at the front of the shelf. Moreover, products located at one part of the shelf may receive more or less attention from a customer than another part of the shelf. Additionally, glare is a source of distraction that diverts the attention of a viewer or consumer away from a displayed product. Attempts to reduce the glare by decreasing the illumination results in even less lighting for the product located near the middle of the shelves. Another common distraction to a consumer or viewer is the heightened contrast or lower uniformity created by the uneven amount of illumination across a display case shelf, when lighting is located near the ends of the shelf. When viewing a series of adjacent display cases, the alternating high and low intensity lighting across the display case shelving is both distracting, and projects an image of non-uniformity. This uneven effect is particularly undesirable when displaying stock of the same product or item across the front of the shelf.

Undesirable glare on the product near the lights may be eliminated by moving or positioning the product or items further towards the rear of the case, away from the immediate area of the light. However, valuable forward display and shelf space is unused by moving product away from the lights. By shifting product in this way, the displayed items would also be located further away from a viewer and appear distant rather than on the shelving up close near the front portion of the displayed case. Similarly, such varied spacing would affect the viewer's perception of the product in the different locations.

With the use of lenses, various of these problems may be reduced or entirely eliminated. Even where they may be reduced, it may be preferable to further reduce such effects, or to achieve even more desirable results with an alternative lighting system. For example,. it may be desirable to further reduce possible glare which may be seen by a viewer or customer outside the display case. Additionally, it may be desirable to selectively distribute light over the shelf as a function of the location along the shelf to be illuminated. Additionally, a fully enclosed light source may improve illumination of product on a shelf with appropriate redirection of light along with improving the performance of the lamp by maintaining the lamp at an optimum operating temperature.

SUMMARY OF THE INVENTION

An improved light fixture is obtained with the present invention which has an increased effective aperture for illuminating product in a display case, which may increase the light output of the lamp by maintaining the optimum temperature for lamp operation, which may further reduce glare as seen by a viewer or customer outside the display case, which may improve the uniformity of light distribution across a shelf or other product display and which may permit selective distribution of light across the product display. Some of these as well as other advantages are provided by a light fixture having at least one baffle adjacent a light source for inhibiting passage of light from the light source past the baffle and an enclosure for surrounding at least part of the light source to inhibit airflow from outside the enclosure to the light source, which inhibition will help to maintain the light source at a uniform temperature for optimum light output. For example, where the light fixture will be used in a refrigerated case, the baffle will reduce or eliminate glare from the light source as seen by a viewer outside the case, as well as maintaining the operating temperature of the lamp within an acceptable range to promote more efficient operation of the lamp, thereby ensuring optimum light output.

In one preferred embodiment of the invention, the light fixture includes a receptacle for receiving a light source, a support for the receptacle and at least one baffle supported adjacent the light source for inhibiting passage of light from the light source past the at least one baffle. An enclosure surrounds the light source and engages the support in such a way that airflow from outside the enclosure to the light source is substantially prevented. In a further preferred embodiment, such as a light fixture used in a freezer case, which typically operates at below zero Fahrenheit, the lamp is positioned within a transparent shield, and the lamp and shield are placed within the enclosure. Additionally, the enclosure may have the baffle formed on the enclosure.

In a further preferred form of the invention, a lighted display case is provided with a light fixture and a baffle element positioned adjacent the light fixture between the fixture and the area where product is to be supported, for reducing the amount of light from the light source that passes from the light source outside of the display case. For example, the display case may include shelves for supporting product within the frame of the display case and the at least one baffle element may be a plurality of baffles positioned adjacent the light source and between the light source and the shelves for reducing the amount of light from the light source that passes outside of the case from the light source, while permitting light from the light source to pass directly toward the product. The plurality of baffles are preferably aligned with the axis connecting the light source and the product, and the baffles may be parallel or angled, as desired to adjust the aperture for the light source, reduce glare as viewed by the viewer outside the case, or adjust the distribution of light across the shelf. The baffles may have matted surfaces on the portions of the surfaces facing outside of the case, and shiny surfaces on the portions facing inside of the case or any combination of surfaces. The baffles may be of different lengths to affect the glare reduction. A reflector may be used to increase illumination at or near the center of the shelf.

In one preferred embodiment of the invention, a plurality of baffles may be mounted on a housing covering the light fixture. The housing may be mounted in such a way that airflow from outside the housing to the inside adjacent the lamp is minimized or eliminated, thereby ensuring an optimum operating temperature for the lamp. In a further preferred form of the invention, foam sealing elements may be placed at opposite ends of the lamp to further insulate the lamp.

The various features of the present invention will be best understood by reference to the following description of the preferred embodiments taken in conjunction with the accompanying drawings.

DESCRIPTION OF THE PREFERRED EMBODIMENTS

The following description taken in conjunction with the drawings sets forth preferred embodiments of the present invention. The embodiments disclosed are the best modes contemplated by the inventors for carrying out their invention in a commercial environment, though it should be understood that various modifications can be accomplished within the parameters of the present invention.

Figure 1:
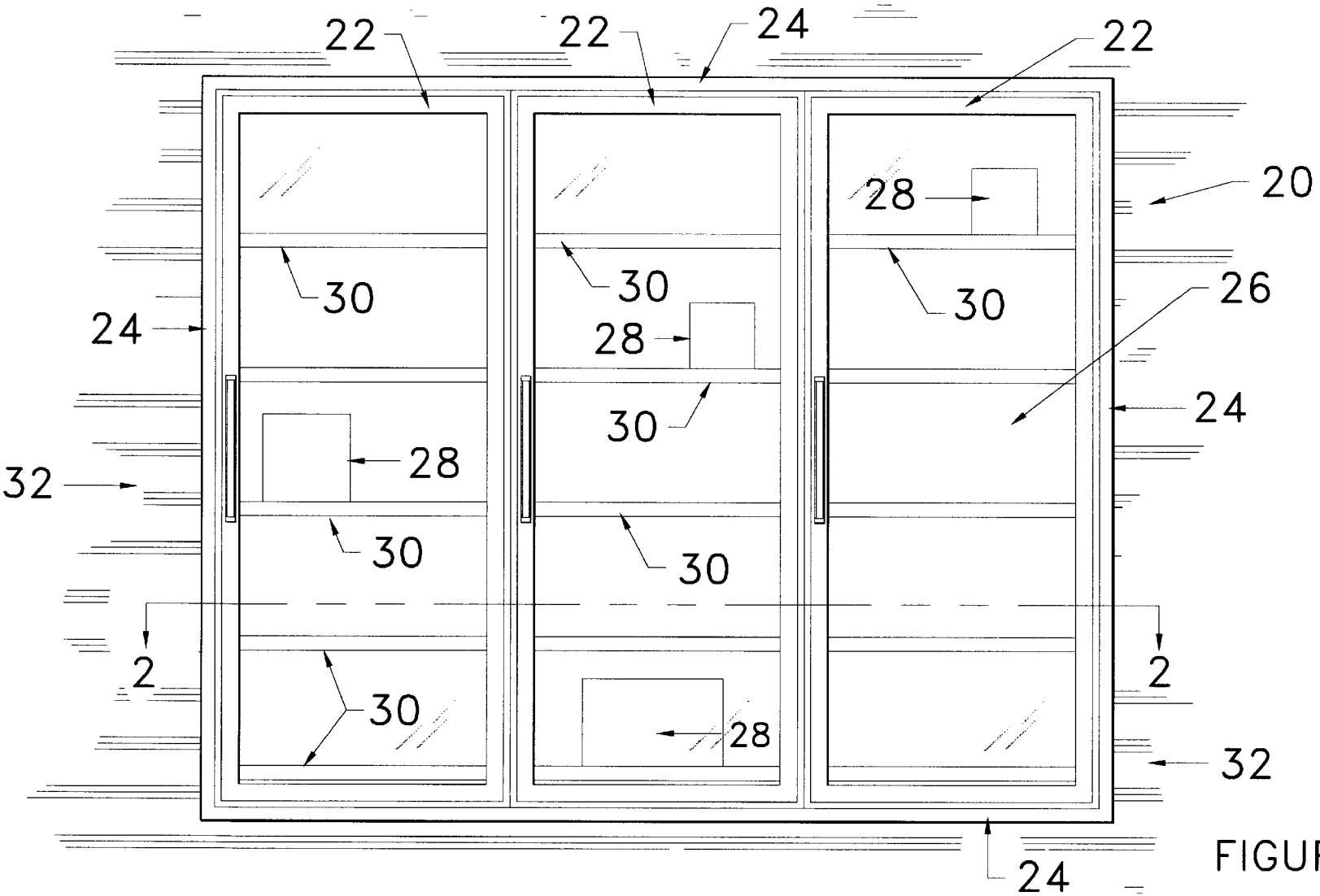
FIG. 1 is an elevational view of a display case with which the present invention may been used having doors mounted thereon and shelves mounted inside the display case.
Figure 2:
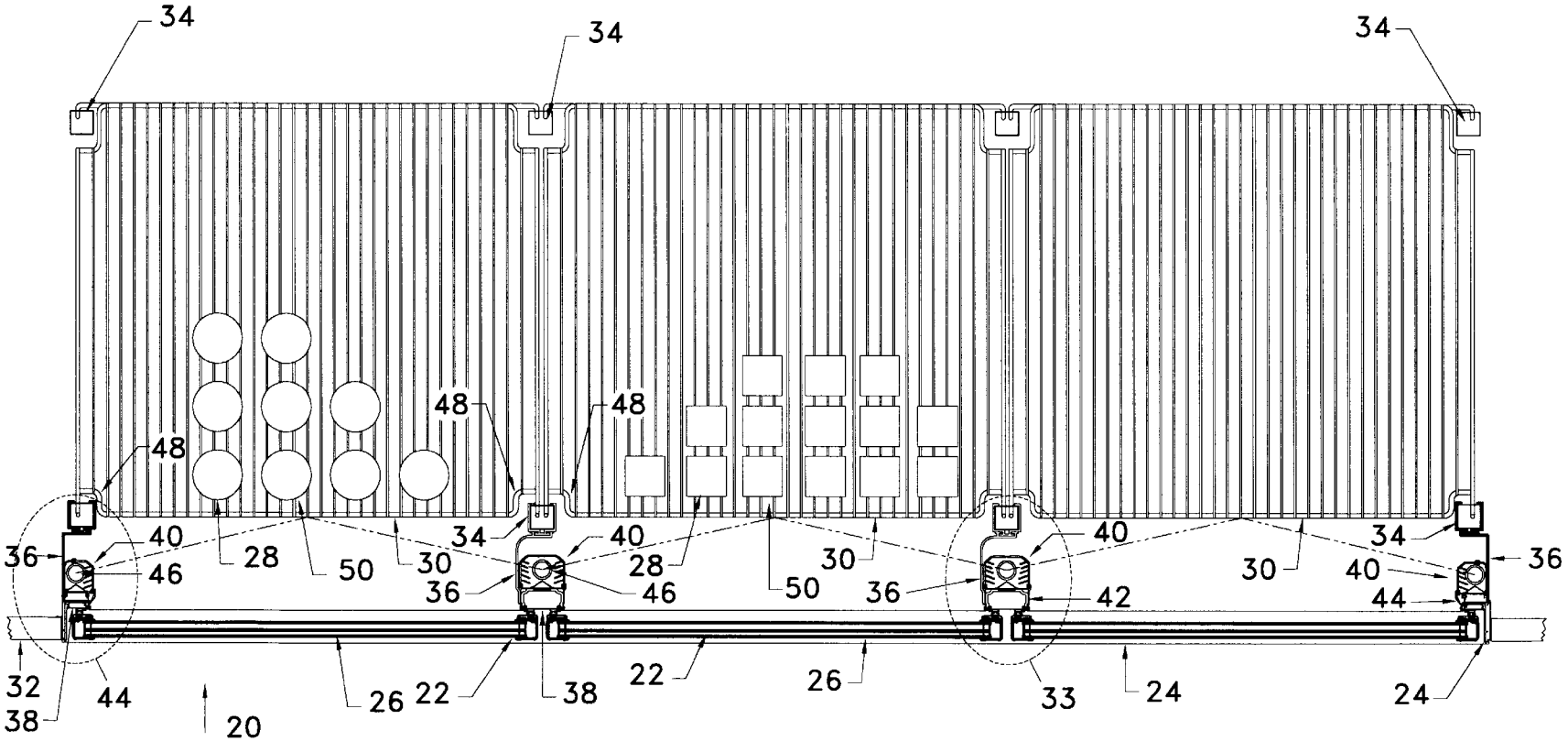
FIG. 2 is a partial cross-sectional view taken in the direction of arrows 2—2 of FIG. 1, showing doors, shelves, and lighting systems for the display case.

Various embodiments of the present inventions are disclosed which provide a greater aperture for a light source, which reduce glare, which permit selective illumination of a product display, which serve as a thermal shield for the light source, which reduce glare or improve light uniformity over a display area or are easier to manufacture, assemble or are less expensive to produce. In the preferred embodiment, the light fixture may be used with a display case 20, having doors 22 mounted in a surrounding frame 24. The doors 22 have glass panels 26 to allow someone, such as a customer in a supermarket, to look through the glass panels 26 at items 28 (FIGS. 1 and 2). The products may be displayed on shelves 30 inside the case 20. The items 28 inside the display case 20 may or may not be refrigerated items 28, such as frozen foods. Typically refrigeration units, for example, use shelves that are assembled in units approximately 30 inches in width across the front of the unit. For more information about display case systems, see Published PCT Application, Publication No. WO 95/16375, the text and drawings of which are incorporated herein by reference. The display case may be mounted in a wall, or may be a free standing unit, or may take any other appropriate configuration, typically where the surrounding frame 34 sets into the opening defined by the wall of the room, by the top, bottom and sides of a free-standing unit, or the like. The structure of the wall or other elements is designated generally as 32.

In multiple door and/or multiple shelf units (FIGS. 1 and 2) the shelves 30 are mounted adjacent each other at the same height or level with respect to each other within the display case 20, or in other arrangements as desired. The shelves are supported by, mounted in or otherwise engage shelf posts 34. The forward shelf posts are typically connected by brackets 36 to frame members or mullions, as is known in the art, for stability and proper spacing of the shelf units. As is typical with refrigeration units, the surrounding frame 24 is set within the opening defined by the walls 32, a floor (not shown), a ceiling and side walls and rear walls (not shown), defining the enclosure which also may be considered a frame or other enclosure for the refrigeration unit. Alternatively, in many refrigeration units, the units are stand-alone units having a support base on legs or casters, top, rear and side walls and one or more doors for accessing product within the display case. Alternatively, one or more of the sidewalls and rear wall may be replaced with doors for additional access. However, it is to be understood, that such-display cases as well as other types of display cases generally include frames or other structures forming the enclosures within which a product is placed for display and selection.

The doors 22 are mounted within the surrounding frame 24, as is also well known in the art. The doors shown in FIG. 2 are swing doors as depicted in FIG. 1, even though the handles for the doors are not depicted in FIG. 2, for simplicity. It should be understood that the doors 22 can also be sliders or other closures. However, in the embodiment of the display case shown in FIG. 2, the doors close and seal against contact plates 38 supported by portions of the surrounding frame, as is well know. As can be seen in FIG. 2, the doors have a substantial amount of viewing area provided by the glass panels 26 so that the product 28 can be viewed from outside the display case. The doors can then be opened so that product can be removed simply by reaching in and grasping product from the shelves 30. Preferrably, the amount of viewing area provided by the doors is maximized so that the product can be viewed with a minimum of obstruction. Shelf space is preferrably maximized and the front, of the shelves 30 are preferrably positioned as close to the doors 22 as possible, while still permitting adequate illumination of the product across the fronts of the shelves. Product at the front of the shelf should be positioned far enough away from the front of the case to allow sufficient illumination so that the product can be adequately lighted.

Lighting fixtures 40 (FIGS. 2–4 and 9–12) are typically mounted to frame elements in display cases in such a way to optimize illumination of product within the display case. In the situation of refrigerated display cases such as that shown in FIG. 2, the light fixtures 40 may be mounted to mullions, such as center mullions 42 and end mullions 44, well known in the art in other configurations. Mullions 42 and 44 may carry wiring, other electronics or heater wires for maintaining the mullions, frame members or contact plates within a desired temperature range. Generally, with reference to FIG. 2, lighting fixtures 40 illuminate product on the shelves 30 by producing light from longitudinally extending fluorescent lamps 46. Bare or unaided lamps generally produce light directed in all directions, with highest intensity adjacent the lamp and the intensity decreasing proportional to the inverse of the square of the distance from the lamp. As a result, product near the end 48 of shelf is highly illuminated while product near the center 50 of the shelf has a lower illumination, being further from the lamp 46. While one solution uses lenses or other light redistribution structures, an alterative uses baffles or louver assemblies to redistribute light.

Bare or unaided lamps 46 also produce glare when light passes directly from the lamp 46 through the glass panes 26 of the doors and viewed by a customer. A series of the lamps 46 produce a substantial glare when a customer views a display case from an angle. Lenses or other light redirecting elements reduce glare but do not eliminate glare as seen by a customer or other person viewing the display cases.

Figure 6:
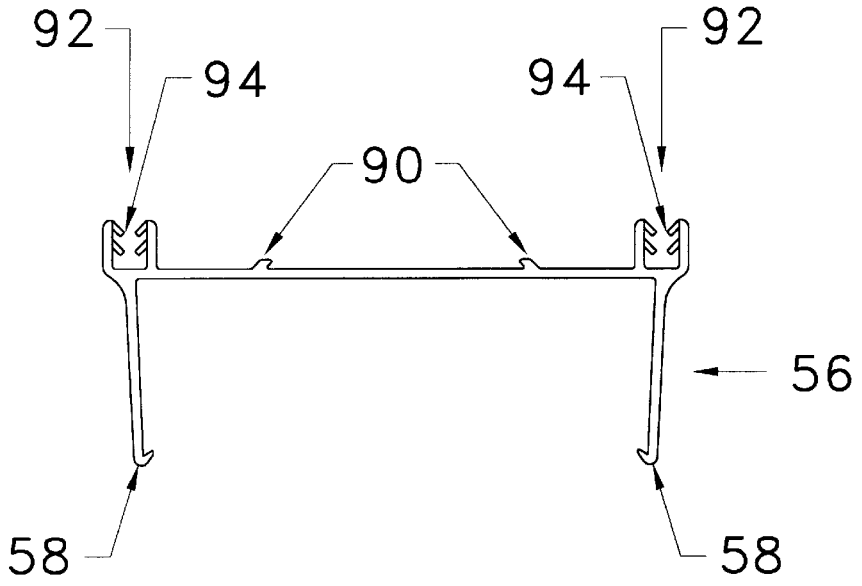
FIG. 6 is an end view of a mullion cover used in one aspect of the present invention for mounting a louver assembly in a display case.
Figure 7:
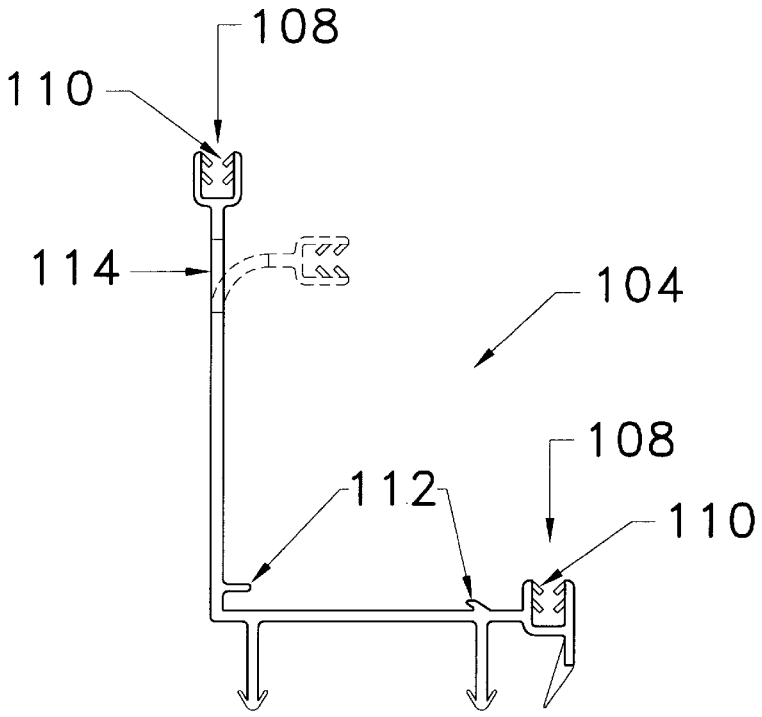
FIG. 7 is an end view of an end mullion cover used with anther aspect of the present invention.
Figure 8:
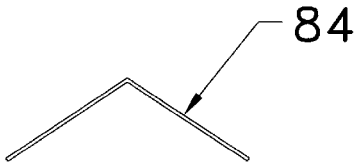
FIG. 8 shows an end view of a reflector element used with another aspect of the current invention.
Figure 9:
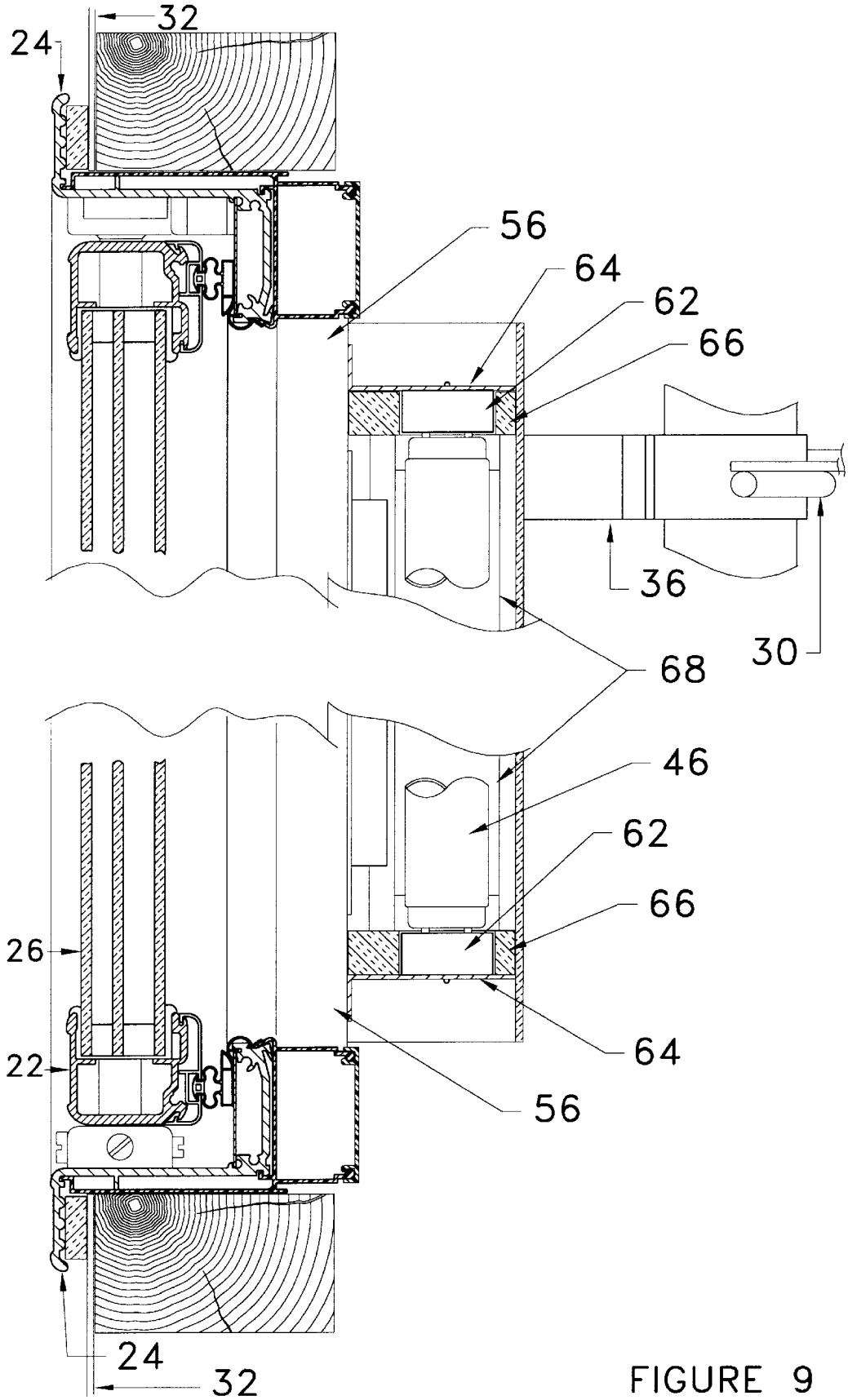
FIG. 9 is a partial section and partial cutaway view of a door, frame and lighting fixture assembly in accordance with one aspect of the present inventions.

In accordance with one aspect of the present invention, a light fixture such as a center mullion light fixture 52 (FIG. 3) is preferrably mounted to the center mullion 54 by a center mullion cover 56 through hooks 58 (FIG. 6) engaging mortises 60 in the outer side surfaces of the mullion 54. The hooks 58 and mortises extend the longitudinal length of the mullion cover and mullion respectively, to ensure adequate engagement and stability.

The light fixture 52 further includes a receptacle for receiving a light source such as lamp 46. In the preferred embodiment described, for longitudinally extending florescent lamps, the lamp is received and retained in, and supplied with energy by sockets 62 such as sockets available from Vossloh - Schwab under the model 47505. (See FIGS. 3 and 9–10.) Sockets 62 are mounted to a preferrably stainless steel or other rigid and strong socket mounting plate 64. Socket mounting plate 64 is mounted to mullion cover 56, and provides a strong support for the sockets as well as a base or backing for insulation, such as foam insulation 66. Insulation 66 thermally seals the end of the lamp and the sockets, and minimizes heat transfer to the outside of the light fixture from the inside. Foam insulation 66 forms part of the insulation for lamp 46 which helps to maintain the lamp in its optimum operating temperature range.

As noted above, the mullion cover is supported by the mullion, which in turn is supported by the surrounding frame for the display case. The surrounding frame in turn is supported by the wall, a base, or other structural support in or on which it is set. Therefore, the lamp is supported by its receptacle or sockets 62, which in turn is supported by the mounting plate 64. The mounting plate 64 is supported in turn by the mullion cover, which is supported by the mullion, which is itself ultimately supported by the base or other support structure for the display case. However, it should be understood that the socket or other lamp receptacle can be supported in any number of ways to ensure that the lamp remains stable and protected. The support for the socket can take any number of forms and is not to be limited to the disclosed structure.

The combination of the preferred socket 62 and the socket mounting plate 64 improve the maintainability of the light fixture and provides a structure which can be easily repaired or replaced. The light fixture is much simpler with this construction relative to pre-existing light fixtures used in refrigerated display cases. In the preferred embodiment of the invention, the lamp includes a conventional clear plastic shield 68 which also helps to maintain the lamp within an optimum operating temperature range. The shield 68 may be mounted around the lamp in any number of ways, as would be apparent to one skilled in the art.

Figure 3:
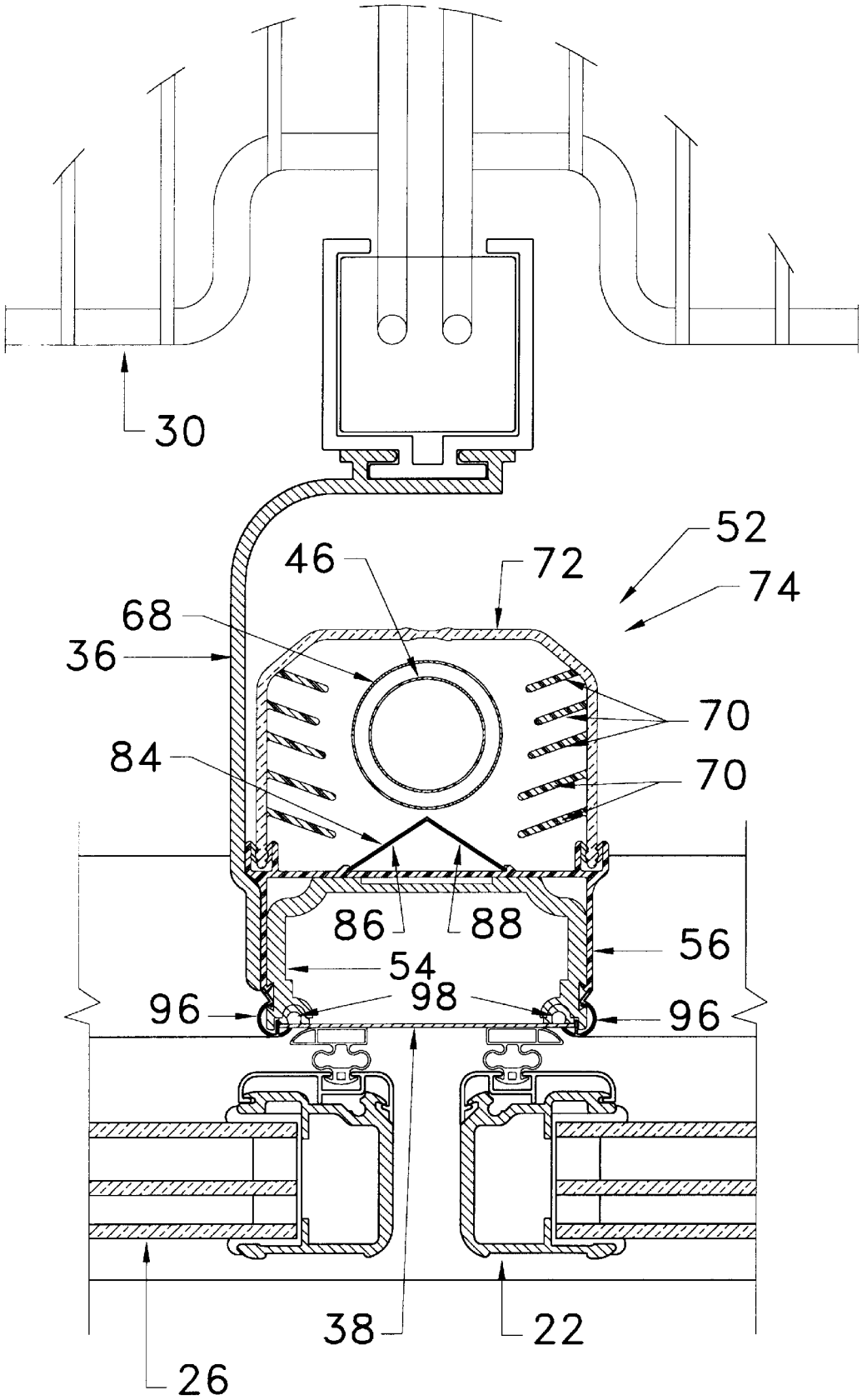
FIG. 3 is a partial cross-sectional detailed view of a door, shelf and lighting fixture assembly taken in the direction of arrows 3—3 of FIG. 2.
Figure 4:
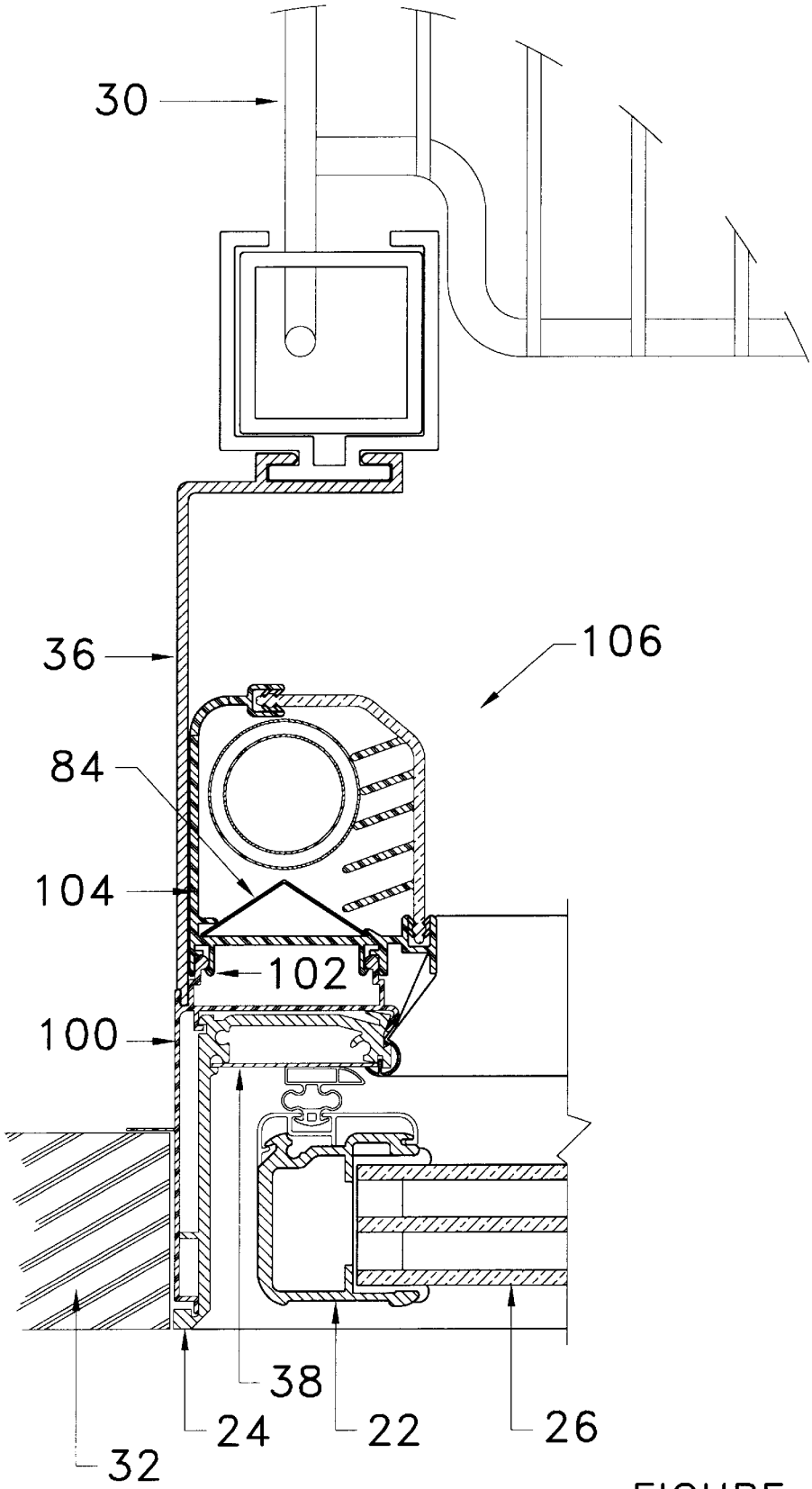
FIG. 4 is an enlarged cross-sectional view of a portion of the refrigerator display case shown in FIG. 2, showing a door, shelf assembly and lighting fixture taken in the direction of arrows 4—4 of FIG. 2.
Figure 10:
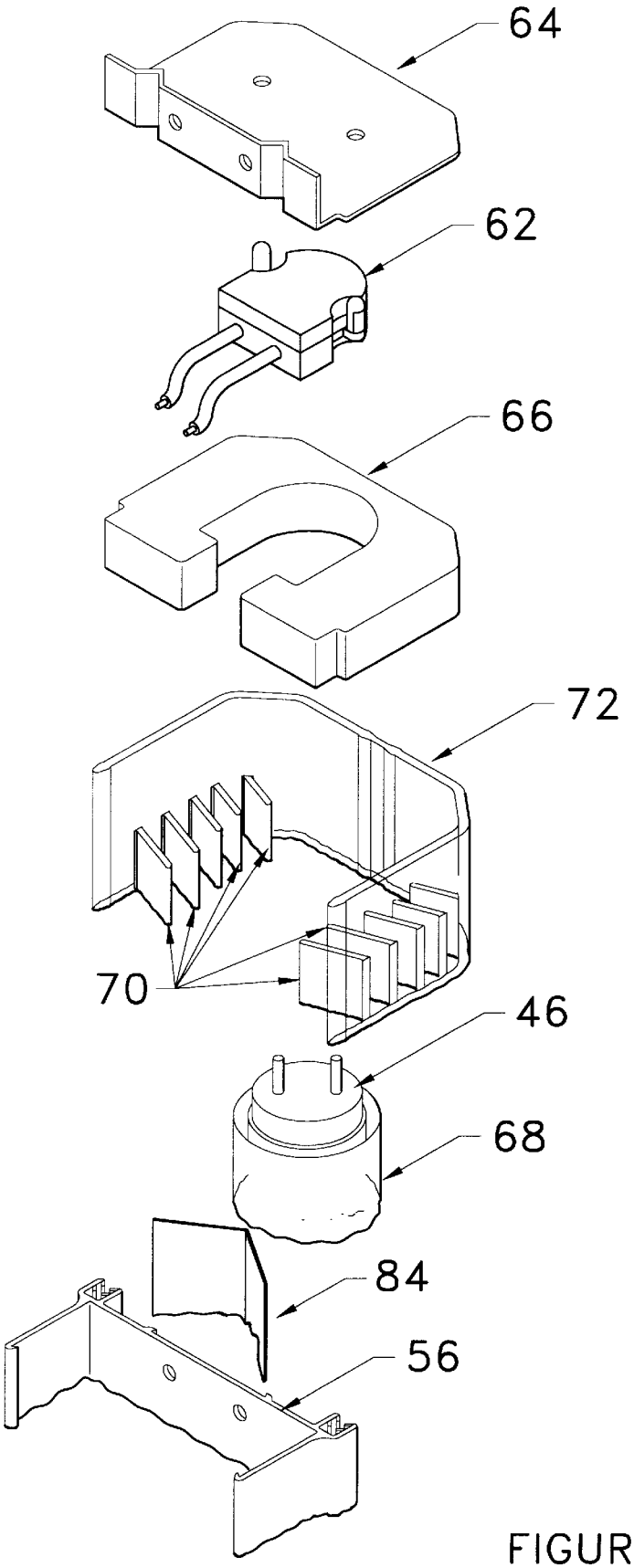
FIG. 10 is an exploded view of partial sections of a lighting assembly used with one aspect of the present invention.
Figure 11:
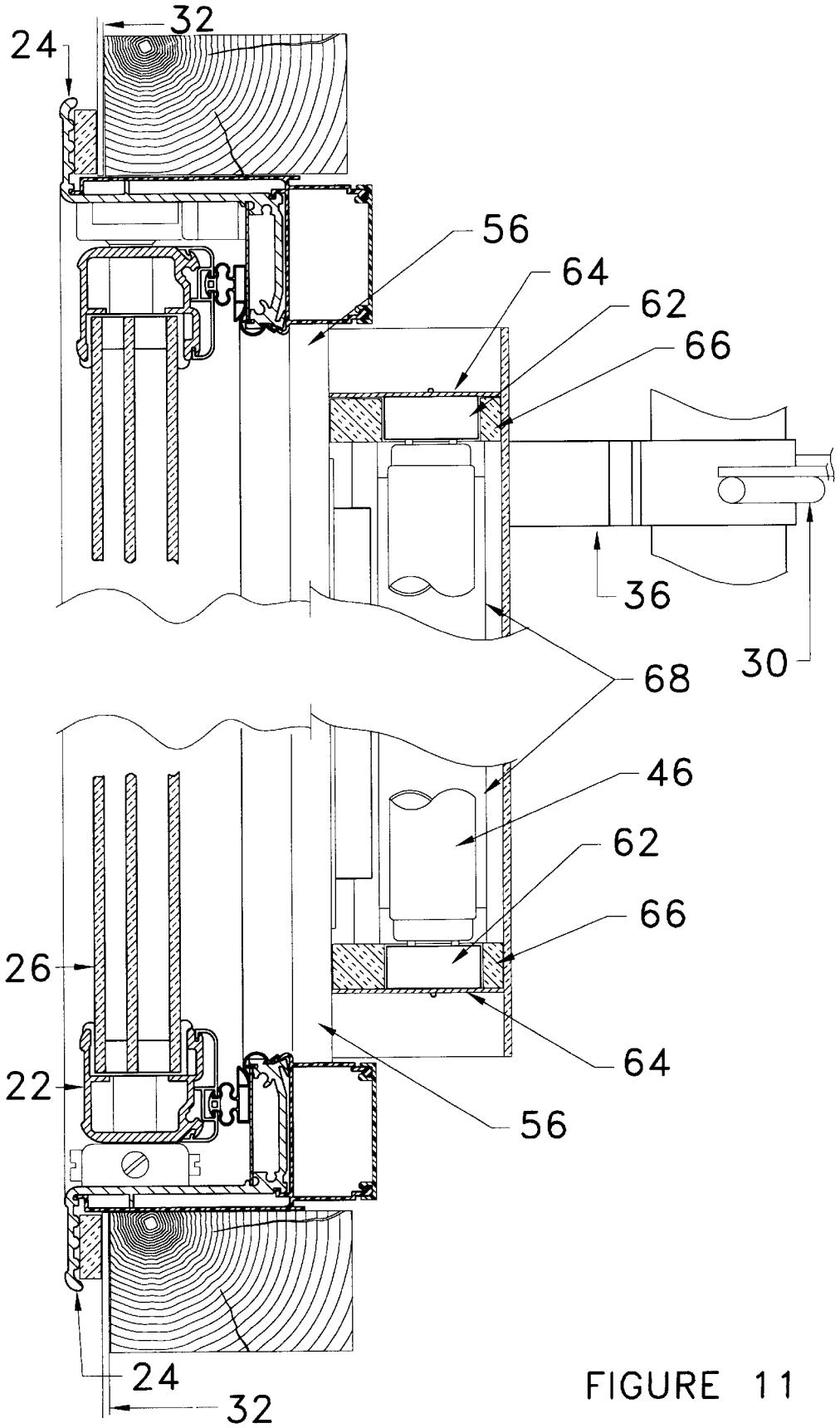
FIG. 11 is a partial section and partial cutaway view of a door, frame and lighting fixture assembly used with a corner section of a display case in accordance with another aspect of the present invention.
Figure 12:
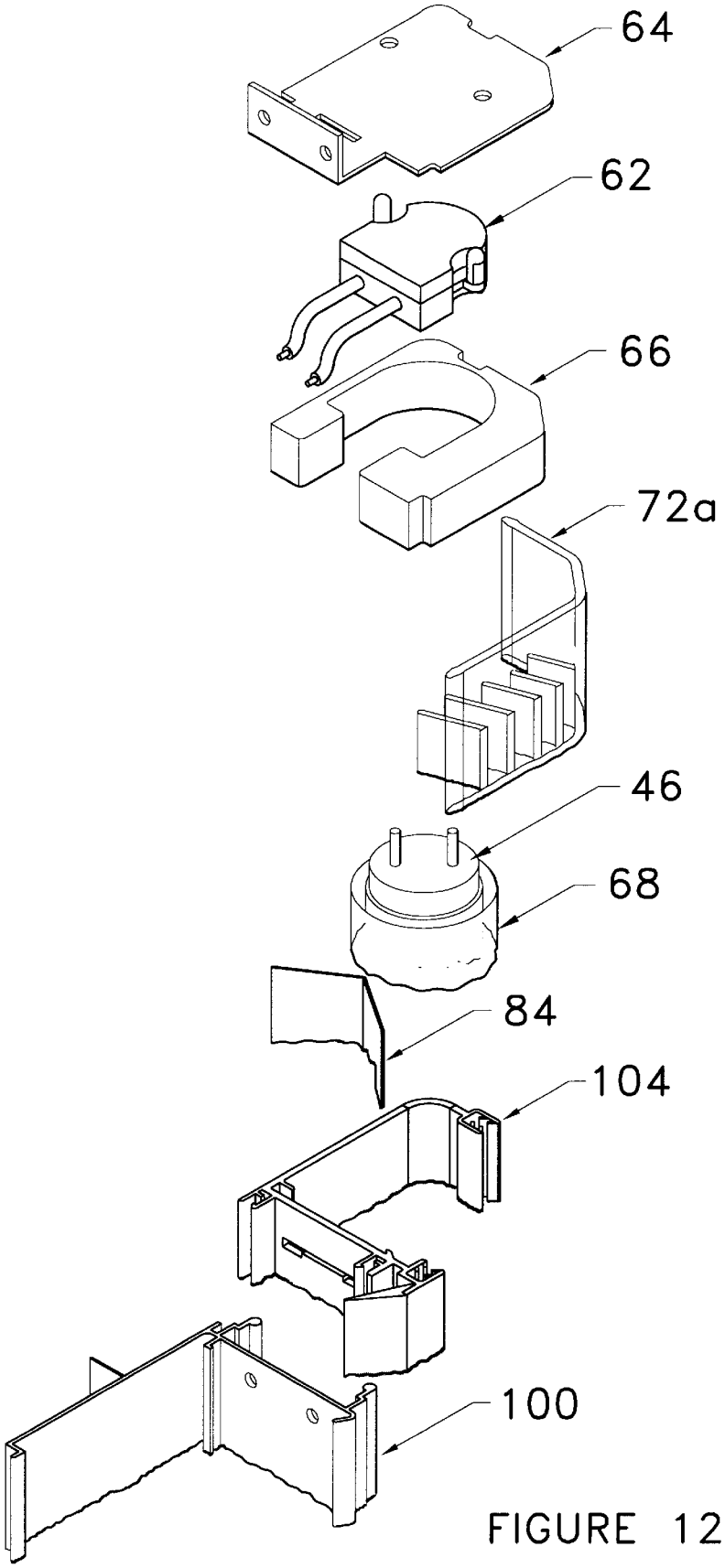
FIG. 12 is an exploded and partial cutaway view of various components of a lighting fixture used in a corner section of a display case in accordance with the aspect of the invention shown in FIG. 11.

In the preferred embodiment, the light fixture 52 further includes at least one baffle, and preferably several baffles 70 supported adjacent the lamp for inhibiting passage of light from the light source past the baffle, so that less or no light, as desired, can pass directly from the lamp 46 out through the glass panes in the door to be seen by a viewer. With the baffles 70, glare from light shining directly from the lamp outside of the case can be entirely eliminated. In the preferred embodiment, the baffles are mounted, attached or otherwise formed (such as by co-extrusion) on interior surfaces of a cover 72 to form a louver assembly 74 for reducing glare, selectively distributing light to illuminate product on the shelves and to provide more uniform light distribution over the product display case. The configuration of the louver assembly shown in FIGS. 3 and 10 provide a greater effective aperture for illuminating product on the shelves by the lamp than presently exists with lens systems and the like. In one preferred embodiment, the baffles 70 are arranged in parallel with respect to each other and extend longitudinally substantially the length of the cover 72, and substantially the length of the lamp 46. The plurality of baffles 70 are also preferrably aligned in such a way as to be parallel to a line or optical axis 73 extending between the center axis of the lamp 46 and the center of the shelf for example where the shelf is a 30 inch shelf. Alignment of the baffles on this axis maximizes the amount of light reaching the center of the shelf, but also serves as baffles for reducing the amount of light illuminating product on the shelf positioned closer to the lamp than the center of the shelf. The effect is to provide more uniformity of illumination for product across the shelf. The plurality of baffles even out the light distribution across the shelf and partially blocks light from passing to the end of the shelf. As a result, high illumination of the end of the shelf is reduced. Contrast of illumination of product across the shelf is improved.

In other embodiments of the louver assembly, the baffles can be angled with respect to each other to selectively reduce glare or selectively change the illumination across the shelf. The angles of the individual baffles 70 affect the effective aperture for the lamp, and the widths of the respective baffles 70 also affect the aperture for the lamp. Furthermore, the length of each individual baffle affects the glare as viewed by a viewer outside the case. Glare is used in this context as the light which would ordinarily pass directly from the lamp 46 outside the case to a viewer, as distinguished from light which passes first from the lamp 46 to product inside the display case.

The louver assembly is preferrably formed of acrylic, polycarbonate or clear PVC, or even glass, though glass is not preferred for areas accessible to the public. The cover 72 preferrably has the highest possible transmissivity for the light produced by lamp 46, while the materials of the baffles preferrably has a low transmissivity, so as to reduce the amount of light passing directly from the lamp to the outside of the case, as desired. While the material for the baffles 70 is preferrably entirely opaque, materials can be selected to have desired transmissivities, whether the same for all baffles or varied for each baffle. In one preferred embodiment of the invention, the surfaces of each individual baffle facing forwardly, namely toward the outside of the case is preferrably matted or otherwise minimally reflective or entirely unreflective. The rearwardly facing surfaces are preferrably shiny, reflective, or otherwise pass light toward product on the shelves. The forward and rearward surfaces can be made to have the desired texture, reflectivity or absorptive characteristics as desired, and may be formed in any number of ways.

Figure 5:
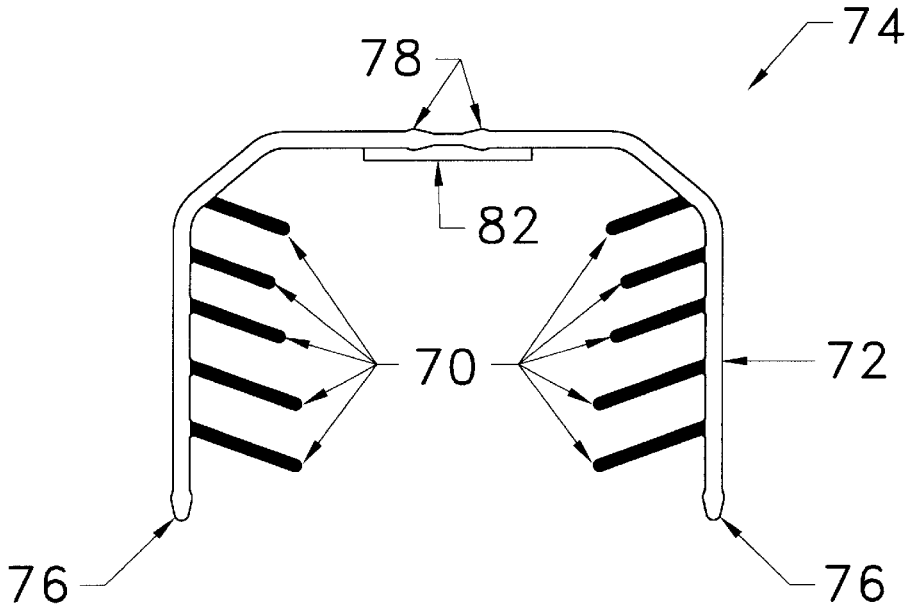
FIG. 5 is a cross-sectional view of a louver assembly in accordance with one preferred embodiment of one aspect of the present invention.

The louver assembly is preferrably mounted to the mullion cover through engagement members or converging ridges 76 which extend longitudinally the length of the louver assembly 74 (FIG. 5). The walls of the cover 72 are preferrably uniform in thickness and the thickness of the baffles 70 are preferrably uniform as well. In the preferred embodiment of the cover, similar converging ridges 78 are formed at the center of the cover 72 and joined by a connecting web 80 which can be severed or removed to form a louver assembly for an end mullion, discussed below with respect to FIGS. 4 and 11–12.

The louver assembly can include various coatings, opaque areas or reflective areas on the inside or outside of the cover, as desired, to mask, absorb or reflect light, as desired. For example, an opaque or only partially transmissive section of the cover can be formed adjacent or surrounding the converging ridges 78 to reduce the light from the lamp which illuminates the ends of the shelves immediately adjacent the light fixture. As a result, uniformity of light distribution across the shelf is improved. Such opaque area is depicted at 82 (FIG. 5), but it should be understood that the area designated by 82 can also be entirely transmissive, as is the rest of the cover.

The light fixture preferrably includes a reflector 84 (FIG. 3) preferrably having a first facet 86 and a second facet 88 for redirecting light from the lamp 46 more toward the center of the shelf. The reflector 84 improves light distribution to the center of the shelf in a manner which is made possible by the louver assembly but which is not readily available with a lens system. The combination of the reflector with the rest of the light fixture therefore improves the uniformity of light distribution across the shelf. The reflector 84 preferrably extends substantially the entire length of the light fixture. The reflector 84 is preferrably biased into and retained by inwardly angled ridges 90 (FIG. 6) for holding the reflector in place on the mullion cover 56.

The mullion cover preferrably includes spaced apart receptacles or channels 92 for receiving the ridges 76 of the louver assembly. The channels 92 preferrably include a plurality of inwardly angled and longitudinally extending ridges or shoulders for engaging the enlarged portion of the converging ridges 76 on the louver assembly, and for securely retaining and positioning the louver assembly on the mullion cover. Other alternative mounting means may be provided for mounting and securing the louver assembly on the mullion cover, while still permitting appropriate removal for replacement or servicing. For example, the louver assembly is preferrably easily removable for replacing the lamp 46.

The secure engagement of the louver assembly 74 with the mullion cover 56 forms another part of the seal for ensuring a reliable enclosure about the lamp 46. The engagement between the louver assembly 74 and the mullion cover 56 reduces or eliminates any airflow and therefore convective heat transfer from the warm lamp to the cold environment of the refrigerated display case. With the secure engagement and enclosure formed by the louver assembly and the mullion cover, the operating environment for the lamp is maintained within a desired temperature range for optimum performance and light output. The engagement between the louver assembly and the mullion cover as well as the use of the foam insulation 66 at opposite ends of the light fixture, along with the shield 68 contribute to optimum performance of the lamp. The cover 72 and the shield 68 form a dual sealed chamber for the lamp, ensuring an optimum temperature range for the lamp. As is typical with many refrigerated display cases, the contact plate 38 is retained in place by clips 96 (FIG. 3), and heater wires 98 may also be provided in appropriate grooves in the mullion.

The light fixtures of the present invention may take a number of forms and may be adapted to different display case configurations. For example, the light fixture described previously may be modified to form an end mullion (FIGS. 4, 7, 11 and 12). However, the function, features and results of the light fixture are preferrably the same or similar as were previously described. The display case frame 24 may include a perimeter frame cover 100, which may be conventional. The frame cover preferrably includes a plurality of longitudinally extending projections 102 having enlarged portions for engaging suitable receptacles (not shown) in mullion cover 104 or may include channels or receptacles for receiving extensions such as those shown in an alternative construction shown in FIG. 7. The light fixture preferrably includes a louver assembly 106 which may be formed from a portion of the louver assembly 74 described above with respect to FIG. 5. As such, the louver assembly 106 has the same or similar functions with the same or similar result as were described previously. The louver assembly is preferrably mounted to, supported by and thermally sealed with the end mullion cover 104 in substantially the same manner as was described above with respect to the louver assembly 74. The end mullion cover preferrably includes channels 108 and ridges 110 for engaging corresponding converging ridges on the louver assembly 106. The reflector 84 is retained and supported by ridges 112. A living hinge 114 facilitates easy installation and removal of the louver assembly for servicing the light fixture or replacing the lamp and may be formed from flexible PVC where the adjacent plastic is rigid PVC.

The light fixtures of the preferred embodiments have a reduced weight relative to other light fixtures having light re-distribution characteristics and use less hardware. The number of parts used for assembly and construction of the light fixtures and display cases is significantly reduced, thereby providing cost savings. Additional cost savings are achieved by reduced labor costs and improved maintenance costs.

In the preferred embodiment, the cover of the louver assembly is formed from clear acrylic and the baffles are formed from black acrylic. The forwardly facing or underside surfaces of the individual baffles is preferrably formed with a non-reflective or matte finish and the louver assembly preferrably has five baffles on each side of the louver assembly for center mullions. One preferred angle of the baffles relative to the front face of the display case or, in other words, relative to the doors, is about 20 degrees. The first baffle adjacent the converging ridge 76 maybe connected approximately 0.525 inches away, the second baffle 0.866 inches away the third 1.194 the fourth 1.463 and the fifth 1.716 inches away. The rearward most surface of the cover may be 2.1 inches away. The tips of the first and second baffles may be 0.59 inches away from the surface of the cover, the third and fifth may be 0.524 inches and the fourth 0.448 inches. The acrylic cover may be 0.09 inches thick and the baffles may be 0.06 inches thick. These dimensions are simply exemplary and may be modified as desired for desired results.

The embodiments disclosed herein show a light fixture and a lighted display case providing a greater aperture for the light source, better thermal properties for the lamp, reduction in glare seen by the viewer, and improved uniformity of light distribution across the shelf.

The above description discloses the preferred embodiments of the present invention. However, various modifications can be made to the preferred embodiments without departing from the functions or results provided by the invention. Therefore, the invention is limited only by the claims appended here to.

I claim:

1. A lighted display case comprising:

a base element;

a frame supported by the base element and defining an enclosure;

at least one product support within the frame for supporting product to be displayed within the display case;

a light fixture supported by the base for receiving and supporting a light source for producing an amount of light; and at least one baffle element positioned adjacent the light fixture and between the fixture and the product support and oriented so as to reduce the amount of light from the light source that passes from the light source in a direction away from the product support toward the outside of the display case.

2. The display case of claim 1 wherein the at least one baffle includes a plurality of baffles.

3. The display case of claim 2 wherein the plurality of baffles are positioned at an angle relative to the light fixture.

4. The display case of claim 3 wherein the plurality of baffles are oriented parallel relative to each other.

5. The display case of claim 2 wherein at least one of the baffles has a matted surface.

6. The display case of claim 5 wherein at least one of the baffles has a relatively shiny surface.

7. The display case of claim 2 wherein the light fixture includes a light source having a longitudinal axis and wherein at least one baffle of the plurality of baffles defines a plane wherein the plane does not intersect the longitudinal axis of the light source.

8. The display case of claim 2 wherein the light fixture includes a light source and wherein at least one of the baffles in the plurality of baffles defines a plane spaced apart from the light source.

9. The display case of claim 2 wherein at least one of the baffles in the plurality of baffles is positioned so as to define a plane which intersects the at least one product support within the frame.

10. The display case of claim 1 further including a reflector adjacent the light source when the light source is supported by the light fixture.

11. The display case of claim 10 wherein the reflector includes a single angle.

12. The display case of claim 11 wherein the reflector has only two facets.

13. The display case of claim 1 further comprising a housing enclosing a substantial portion of the light fixture.

14. The display case of claim 13 wherein the housing includes a plurality of baffles.

15. The display case of claim 13 further comprising a longitudinally extending support supported by the base for supporting the light fixture, and wherein the housing includes longitudinally extending engagement members for engaging the light fixture support.

16. The display case of claim 15 wherein the engagement members include converging elements for engaging the light fixture support.

17. The display case of claim 13 wherein the light fixture support includes at least one groove for engaging the converging engagement members on the housing.

18. The display case of claim 17 wherein the at least one groove includes at least two longitudinally extending ridges on each side of the groove for engaging the converging engagement members on the housing.

19. The display case of claim 18 wherein the light fixture support includes a plurality of grooves, and wherein each groove includes a plurality of ridges for engaging the converging engagement members on the housing.

20. The display case of claim 13 wherein the light fixture support comprises a mullion and wherein the mullion includes a mullion cover having a living hinge connecting a longitudinally extending groove element to the mullion cover wherein the longitudinally extending groove element engages a portion of the housing.

21. The display case of claim 1 wherein the at least one product support includes a shelf having a substantially straight front edge, and further including a housing over the light fixture and wherein a light source engaging the light fixture defines a first axis and wherein the shelf has a shelf center such that a line between the shelf center and the first axis defines an optical axis and wherein at least one baffle is positioned and extends in a direction parallel to the optical axis.

22. A lighted display case comprising:

a base element;

a frame supported by the base element and defining an enclosure;

at least one product support within the frame for supporting product to be displayed within the display case;

a light fixture supported by the base for receiving and supporting a light source for producing an amount of light; and a plurality of baffles positioned adjacent the light fixture and between the fixture and the product support for reducing the amount of light from the light source that passes from the light source outside of the display case, wherein at least two of the plurality of baffles have different lengths.

23. The display case of claim 22 wherein three adjacent baffles are progressively shorter.

24. A lighted display case comprising:

a base element;

a frame supported by the base element and defining an enclosure;

at least one shelf within the frame for supporting product to be displayed within the display case;

a door supported by the frame for permitting viewing of product on the shelf; a light fixture supported by the base for receiving and supporting a light source for producing an amount of light;

a housing enclosing a portion of the light fixture and the light source; and at least one baffle element positioned on the housing and adjacent the light fixture and oriented so as to reduce the amount of light from the light source that passes from the light source through the display case door outside of the display case.

25. The display case of claim 24 wherein the housing includes a plurality of baffles, at least two of which are positioned on the housing so as to be oriented parallel to each other defining respective planes which intersect the shelf.

26. The display case of claim 24 wherein the at least one baffle element includes a plurality of baffles and at least some of the baffles are positioned on the housing and define respective planes which intersect the light source.

27. The display case of claim 24 wherein the at least one baffle element is positioned at an angle relative to the housing.

28. The display case of claim 27 further comprising a plurality of baffles oriented parallel relative to each other.

29. The display case of claim 24 wherein the at least one baffle element includes a plurality of adjacent baffles, which are progressively shorter.

30. The display case of claim 24 wherein the at least one baffle element has a matted surface.

31. The display case of claim 24 wherein the at least one baffle element has a relatively shiny surface.

32. The display case of claim 24 wherein the at least one baffle is entirely opaque.

33. The display case of claim 32 wherein the opaque baffle has first and second sides and wherein a first side is reflective and a second side is at least partly non-reflective.

34. The display case of claim 32 wherein the at least one baffle includes a plurality of baffles that are opaque.

35. The display case of claim 24 wherein the at least one baffle includes a plurality of baffles having different lengths.

36. A lighted display case comprising:

a base element;

a frame defining an enclosure;

at least one shelf within the frame for supporting product to be displayed within this display case;

a door supported by the frame for permitting viewing of product on the shelf and movable to permit access to the product;

a light fixture supported by the base for receiving and supporting a light source for producing an amount of light;

a housing enclosing at least part of the light source; and at least one opaque baffle element supported by the housing and positioned adjacent the light fixture such that the amount of light from the light source that passes from the light source out of the display case door is reduced relative to the amount of light that would pass without the at least one baffle element.

* * * * *

UNITED STATES PATENT AND TRADEMARK OFFICE

CERTIFICATE OF CORRECTION

PATENT NO. : 5,879,070

DATED : March 9, 1999

INVENTOR(S) : Paul Severloh

It is certified that error appears in the above-indentified patent and that said Letters Patent is hereby corrected as shown below:

On the face of the patent, after "[22] Filed: October 12, 1995", and before "[51] INT. CI.", insert -- Related U.S. Application Data

[62] Continuation-in-Part of Serial No. 08/486,523, filed June 7, 1995, Patent No. 5,895,111. --

Signed and Sealed this

Thirtieth Day of November, 1999

*Attest:*

*Attesting Officer*

Q. TODD DICKINSON

*Acting Commissioner of Patents and Trademarks*

UNITED STATES PATENT AND TRADEMARK OFFICE

CERTIFICATE OF CORRECTION

PATENT NO. : 5,879,070

DATED : March 9, 1999

INVENTOR(S) : Paul Severloh

It is certified that error appears in the above-identified patent and that said Letters Patent is hereby corrected as shown below:

On the title page

1995", and before "[51] INT. CI.", insert

-- Related U.S. Application Data

[62] Continuation-in-Part of Serial No. 08/486,523, filed June 7, 1995, Patent No. 5,895,111. --

Signed and Sealed this

Seventh Day of December, 1999

*Attest:*

Q. TODD DICKINSON

*Attesting Officer*

*Acting Commissioner of Patents and Trademarks*